US005456819A

United States Patent [19]

Lashmore et al.

[11] Patent Number: 5,456,819

[45] Date of Patent: Oct. 10, 1995

[54] PROCESS FOR ELECTRODEPOSITING METAL AND METAL ALLOYS ON TUNGSTEN, MOLYBDENUM AND OTHER DIFFICULT TO PLATE METALS

[75] Inventors: David S. Lashmore, Frederick, Md.; David Kelley, Martinsburg, W. Va.

[73] Assignee: The United States of America as represented by the Secretary of Commerce, Washington, D.C.

[21] Appl. No.: 130,533

[22] Filed: Oct. 1, 1993

Related U.S. Application Data

[63] Continuation of Ser. No. 813,599, Dec. 26, 1991, abandoned.

[51] Int. Cl.[6] ..... C25D 5/38

[52] U.S. Cl. ..... 205/212; 205/81; 205/219

[58] Field of Search ..... 205/212, 219, 205/81

[56] References Cited

U.S. PATENT DOCUMENTS

| | | | |
|---|---|---|---|
| 923,864 | 6/1909 | Levy | 205/210 |
| 931,944 | 8/1909 | Mathers | 205/238 |
| 1,501,049 | 7/1924 | Harper | 30/345 |
| 1,787,477 | 1/1931 | Hanley et al. | 205/216 |
| 2,313,756 | 3/1943 | Loose | 205/210 |
| 2,443,651 | 6/1948 | Cannizzaro | 205/212 |
| 2,546,150 | 11/1956 | Brenner | 205/176 |
| 2,772,227 | 11/1956 | Quaeley et al. | 205/228 |
| 2,801,213 | 7/1957 | Beuckman et al. | 205/182 |
| 2,835,630 | 5/1958 | Huddle et al. | 204/1.5 |
| 3,239,439 | 3/1966 | Helmke | 205/219 X |
| 3,627,650 | 12/1971 | Seuffert | 205/102 |
| 3,699,013 | 10/1972 | Miyata et al. | 205/212 |
| 4,461,680 | 7/1984 | Lashmore | 205/104 |
| 4,465,561 | 8/1984 | Nguyen et al. | 205/212 X |
| 4,632,734 | 12/1986 | Mix | 205/170 |
| 4,655,884 | 4/1987 | Hills et al. | 205/181 |
| 4,786,324 | 11/1988 | Rieger | 106/1.27 |
| 4,990,224 | 2/1991 | Mahmoud | 205/149 |

OTHER PUBLICATIONS

Metal Finishing Guidebook and Directory For 1975, Metals and Plastics Publications, Inc., Hackensack, N.J., pp. 184–186. Month of publication not available.

F. A. Lowenheim, Electroplating, McGraw–Hill Book Co., New York, 1978, pp. 232–233. Month of publication not available.

Metal Finishing Guidebook and Directory for 1975, Metals and Plastics Publications, Inc., Hackensack, N.J., pp. 268–270. Month of publication not available.

Melvin Goldberg, *Baths for Cleaning and Strike Plating Difficult–To–Plate Metals, Mo, Nb, W, Si, and Al, Selected Using Pourbaix Diagrams,* (A Symposium), Oct. 30 & 31, Hyatt Regency, New Orleans, La. (1980).

*Primary Examiner*—John Niebling
*Assistant Examiner*—William T. Leader
*Attorney, Agent, or Firm*—Stevens, Davis, Miller & Mosher

[57] ABSTRACT

This invention relates to an electrochemical treatment of metal substrates, including so-called "difficult to plate metals" such as tungsten and molybdenum, wherein deoxidation and plating are carried out in the same electrolyte bath by exploiting the electrochemical window in potential and pH of a reduction/deposition. This window may be illustrated using Pourbaix diagrams. In the first step of the treatment, a direct current at a reduction potential is applied to the substrate to reduce oxides present on the surface of the substrate without causing metal to be deposited from the electrolyte. In the second step, the reduction potential is changed to a more negative deposition potential, and a direct current at this deposition potential is applied for a time sufficient to deposit metal from the electrolyte.

15 Claims, 3 Drawing Sheets

OVERLAY OF POURBAIX DIAGRAMS OF Ni, Cu AND W WITH REGIONS OF BARE METAL STABILITY INDICATED (PLATING REGIONS)

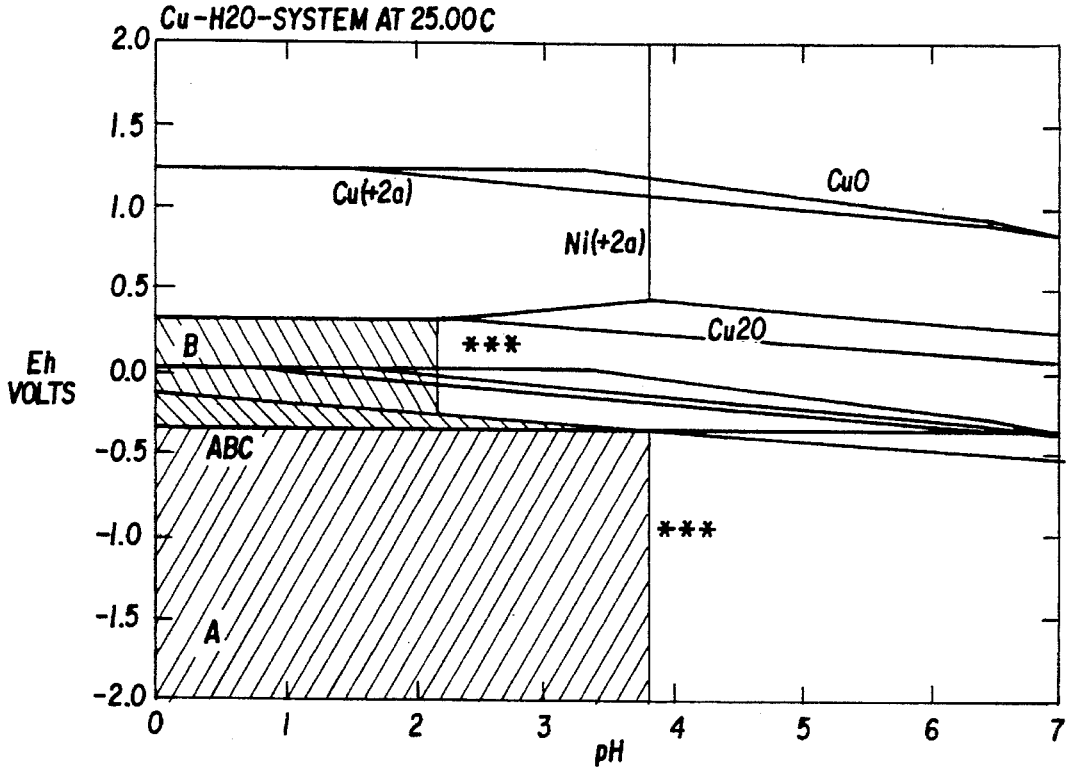
FIG. 1 OVERLAY OF POURBAIX DIAGRAMS OF Ni, Cu AND W WITH REGIONS OF BARE METAL STABILITY INDICATED (PLATING REGIONS)
FIG. 2 POURBAIX DIAGRAM OF Ni ILLUSTRATING REGION WHERE Ni IS OXIDE FREE
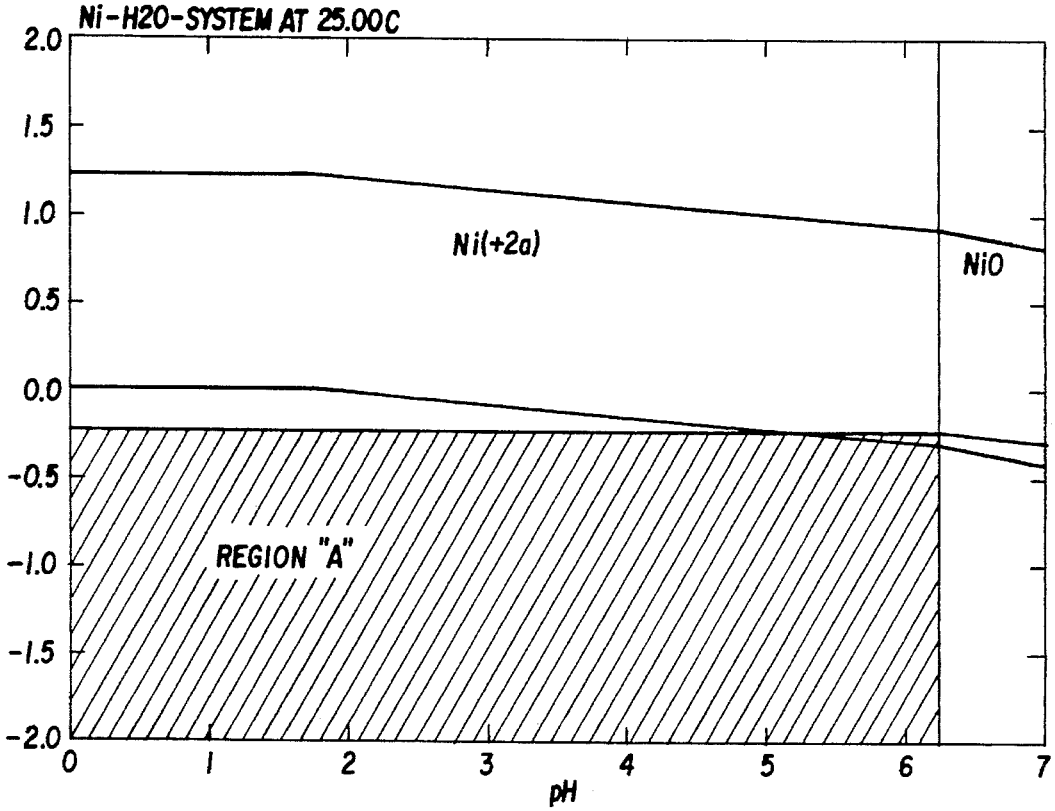

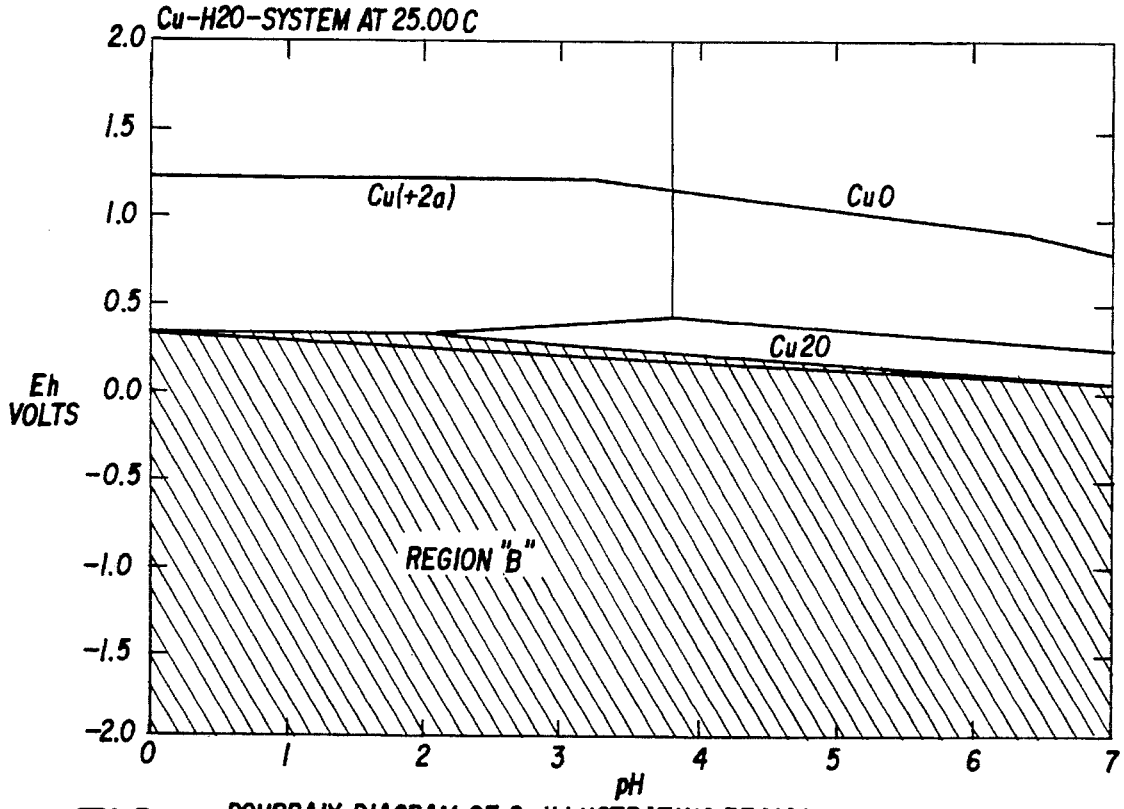
FIG. 3 POURBAIX DIAGRAM OF Cu ILLUSTRATING REGION WHERE Cu IS OXIDE FREE
FIG. 4 POURBAIX DIAGRAM OF W ILLUSTRATING REGION WHERE W IS OXIDE FREE
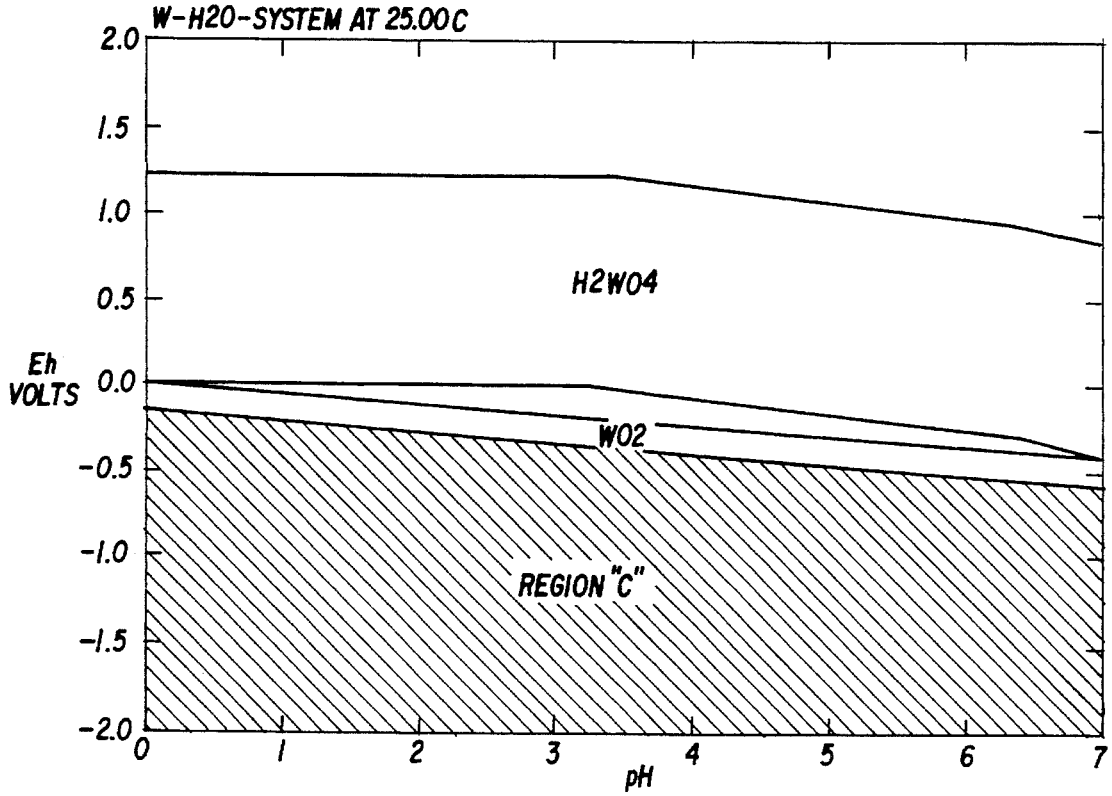

PROCESS FOR ELECTRODEPOSITING METAL AND METAL ALLOYS ON TUNGSTEN, MOLYBDENUM AND OTHER DIFFICULT TO PLATE METALS

This application is a continuation of application Ser. No. 07/813,599, filed Dec. 26, 1991, now abandoned.

FIELD OF THE INVENTION

This invention relates to processes for the coating of metals by electrodeposition. In particular, the invention relates to the improved adhesion of metals electrodeposited onto base metals which are difficult to plate because of the characteristic of such base metals to oxidize rapidly.

BACKGROUND OF THE INVENTION

With the exception of the noble metals (Pt, Au, etc.) all metals and their alloys will form oxide films whose removal is required before another metal or metal alloy (hereinafter jointly referred to as "metal") may be electrochemically deposited thereon. Many of these oxides can be substantially removed by appropriate cleaning treatments such as acid etching or sand blasting prior to plating. The oxides formed on metals (e.g., substrate) such as tungsten, copper-tungsten and molybdenum, as well as niobium, titanium and aluminum (referred to here only as examples of readily oxidizable metals) are, however, more complicated and more tenacious than most and require special procedures to ensure proper adhesion of the coating to the base metal.

Several methods have been proposed for the removal of oxide built-up on the surface of readily oxidizable metals. U.S. Pat. No. 2,443,651 to Cannizzaro discloses an electroetching process of tungsten in an aqueous solution containing 5% to 50% hydrofluoric acid while passing an alternating current at a voltage on tile order of 5 volts through the solution. Following the electroetching process, the tungsten article to be electroplated is removed from the acid bath and then immersed in the plating bath and plated.

U.S. Pat. No. 2,835,630 to Alfred, et al. suggests that shot blasting of the tungsten or molybdenum article to be plated is to be preferred over electrochemical cleaning because of the hydrous oxide produced thereby. The shot blasted surface is subsequently coated with copper and then a final metal coating is applied.

Yet another cleaning treatment for readily oxidizable metals is proposed in U.S. Pat. No. 3,699,013 to Miyata et al. The process described therein involves an acid etch, followed by a water rinse which is further followed by a rinse with a dehydrating organic solvent which acts to prevent the build-up of oxides from the oxygen dissolved in the water.

Although the procedures outlined above may produce a more adherent electrodeposited coating on readily oxidizable base metals, they all have the drawback of being comprised of multiple steps carried out with exposure to air or intermediate solutions between the primary steps of cleaning or deoxidizing and electroplating.

Several U.S. Patents suggest processes for cleaning the base metal in the same bath in which the electroplating process occurs. For example, U.S. Pat. No. 923,864 to Levy discloses such a single bath process, however, both the cleaning and plating steps are said to occur at a single current level and simultaneously. In addition, the disclosed electrolyte will not work for the difficult to plate metals.

U.S. Pat. No. 2,546,150 to Brenner discloses a single bath process in which the cleaning is accomplished by application of alternating current (A.C.) prior to application of the direct (D.C.) plating current. The A.C. process described is both an oxidation and a reduction process.

U.S. Pat. No. 4,990,224 to Mahmoud discloses a single bath process wherein the primary deoxidation is the result of a sulfuric acid soak. It is disclosed that the deoxidation may be enhanced by the application of a short period of positive current prior to applying the plating current.

Finally, U.S. Pat. No. 3,627,650 to Seuffert discloses a single bath process for electroplating wherein a potential below the plating potential of the metal to be deposited is applied to the article while in air, followed by immersion of the article into the plating bath and then increasing the potential incrementally to the final plating potential. The application of a potential to the article while in air acts to inhibit dissolution when the article is placed into an aggressive solution.

The above processes, improved as they may be over the usual methods of pre-cleaning and electroplating do not, however, reduce the number of steps in the overall electrodeposition process nor the time required to carry out such overall electrodeposition process. Furthermore, these processes do not make use of Pourbaix diagrams (e.g., knowledge of the thermodynamics) nor do they involve potentiostatically controlled reduction processes.

It has been suggested by Dr. Melvin Goldberg, in a paper titled "Baths for Cleaning and Strike Plating Difficult-to-Plate Metals, Mo, Nb, W, Si and Al, Selected using Pourbaix Diagrams" delivered at the American Electroplaters Society Symposium on Plating on Difficult-to-Plate Metals held during October, 1980 in New Orleans, Louisiana, that Pourbaix diagrams are useful for understanding the chemistry and electrochemistry of cleaning and strike plating solutions.

The disclosures of each of the above mentioned U.S. Patents and the paper of Dr. Goldberg are herein incorporated, in their entirety, by reference.

OBJECTS OF THE INVENTION

It is, therefore, an object of the invention to overcome the deficiencies in the prior art electroplating processes, especially as to improving adhesion of the plated metal on the base metal.

It is a further object of the present invention to provide an improved method based on knowledge of thermodynamics for electrodepositing metals and metal alloys onto base metals, including the so-called "difficult to plate metals" including, but not limited to, tungsten, copper-tungsten and molybdenum, with the result that such an improved process produces superior adhesion of the coating to the base.

It is a further object of the present invention to provide an improved electroplating process wherein the primary deoxidation and plating steps are carried out in the same electrolyte bath with a minimum number of processing steps and in a minimum amount of time. The deoxidation and plating steps of the present invention are well defined, separate steps.

SUMMARY OF THE INVENTION

Applicants have developed new processes for producing adherent metallic coatings on metal substrates, including the so-called "difficult to plate metals" which reduce the number of steps in the overall electrodeposition process and the time required to carry out such overall electrodeposition process. This new process accomplishes the objects of the invention by, after a detailed study of the Pourbaix diagrams of the constituents involved, monitoring the oxide reduction current and controlling the potential.

The present invention provides an electrochemical treatment wherein the oxide film on the surface of the metal article to be plated, is reduced to the bare (non-oxidized) metal followed by the deposition process, which is carried out in the same electrolyte and without removal of the article to be plated from the electrolyte. This process precludes the need to transfer the article from one electrolyte to another between deoxidizing and plating steps, thus eliminating the chance of reforming an oxide film or otherwise contaminating the surface of the bare metal.

The present invention exploits an electrochemical "window" in potential and pH of a deoxidizing/plating electrolyte where an oxide build-up on an article to be plated can be electrochemically reduced to the bare metal substrate and where a metal to be plated, which is deliberately placed in the deoxidizing/plating electrolyte, will not plate out during such electrochemical reduction step. After a predetermined time sufficient to reduce the oxide to the bare metal has passed, the potential is made even more cathodic in order to cause the plating-out of the metal onto the electrochemically reduced base metal.

BRIEF DESCRIPTION OF THE DRAWINGS

FIG. 1 is an overlay of the Pourbaix diagrams of tungsten, copper and nickel.

FIG. 2 is the Pourbaix diagram of nickel.

FIG. 3 is the Pourbaix diagram of copper.

FIG. 4 is the Pourbaix diagram of tungsten.

DETAILED DESCRIPTION OF THE INVENTION

The basis for the present invention is illustrated in the Figures. FIG. 1, which is an overlay of the Pourbaix diagrams of nickel, tungsten and copper, illustrates the window "ABC" in potential and pH where it is thermodynamically possible to reduce the tungsten oxide to produce an electrochemically cleaned metal surface without causing the nickel in the electrolyte bath to plate-out and at the same time preventing metals from dissolving. The diagrams also illustrates the electrode potential at which the nickel will plate-out without changing the pH of the electrolyte.

Thus, it is possible to electrochemically (cathodically) reduce the metal oxide on a metal substrate to bare metal in a dilute hydrofluoric or fluoroboric acid electrolyte.

More specifically, FIG. 1 shows three important regions, each of which is shown separately in FIGS. 2–4. In region A, the limits of nickel electroplating from the acid fluoride (hydrofluoric or fluoroboric) electrolyte are marked. In region B, the area representing stable metallic copper is represented. Region "C" marks the area in which the oxide of tungsten can be reduced without dissolving copper. Nickel is then plated by reducing the potential (more negative) to region "A". Since it takes a finite amount of time to reduce the oxide on the tungsten base metal, the potential is placed slightly anodic of region "A" but within region C for a predetermined time, after which the potential is lowered into region "A" where nickel will be deposited on the substrate.

FIGS. 2, 3 and 4 are conventional Pourbaix diagrams of nickel, copper and tungsten, respectively.

Figure 5:
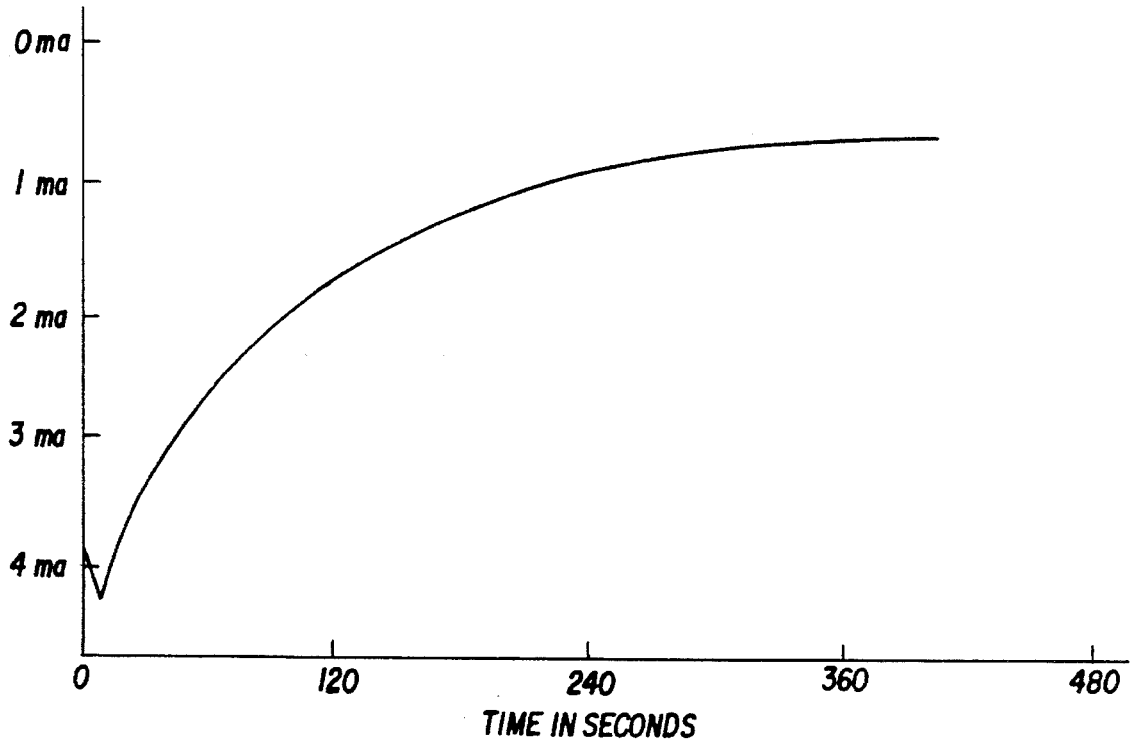
FIG. 5 shows the current response to a –400 mV pulse applied to a tungsten electrode illustrating the decay accompanying the oxide dissolution.
Figure 6:
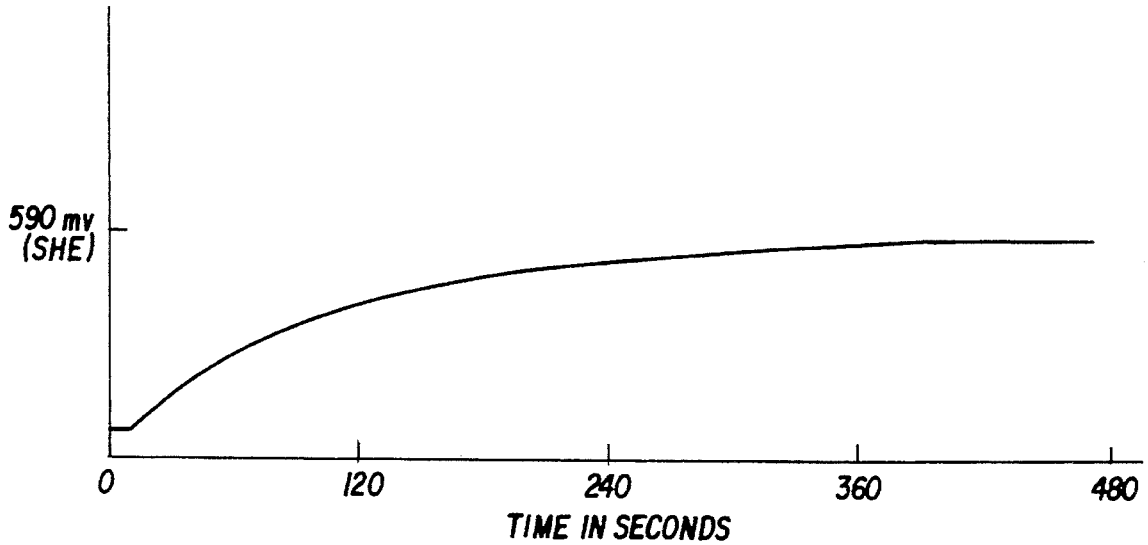
FIG. 6 shows the potential response to a 600 μa pulse applied to a tungsten electrode illustrating the charging potential as the oxide is dissolved.

The time required to reduce the tungsten oxide to metal may be determined by applying a fixed voltage to the tungsten article and measuring the current response as a function of time. FIG. 5 is illustrative of this. Alternatively, as shown in FIG. 6, a fixed current may be applied to the article with subsequent measurement of the potential response over time. The curve of FIG. 5 is more sensitive than that shown in FIG. 6.

Without further elaboration, it is clear that one skilled in the art can, using the preceding description, utilize the present invention to its fullest extent. The following preferred embodiment is, therefore, to be construed as merely illustrative, and not limitative of the remainder of the disclosure in any way whatsoever.

EXAMPLE

A copper-tungsten alloy article is degreased in acetone followed by a water rinse. The article is then dipped in a 10 v/o solution of sulfuric acid ($H_2SO_4$) for 60 seconds followed by a water rinse. Finally, the copper-tungsten article to be plated is immersed, with the current on, in the reduction and deposition electrolyte (hereinafter "Electrolyte A"), the composition and characteristics of which are set forth below, at a reduction potential of –0.4 V for a period for 2.0 minutes. After 2.0 minutes in Electrolyte A at –0.4 V, the deposition potential is changed to –1.1 V SCE (saturated calomel electrode) for a period of 2.5 minutes. After 2.5 minutes at –1.1 V, the copper tungsten article may be over-plated in an over-plate electrolyte, (hereinafter "Electrolyte B"), the composition and characteristics of which are set forth below. Without rinsing and with the current off, the copper-tungsten article is immersed into Electrolyte B. The plating potential is applied, and, after 5 minutes, the plated article is removed from Electrolyte B, rinsed with water and dried.

Electrolyte A. Reduction and Deposition Electrolyte

Nickel Sulfate ($NiSO_4 \cdot 5H_2O$)—30 g/l (grams/liter)

Hydrofluoric acid (HF)—50 ml/l (milliliters/liter)

Surfactant (Triton 100)—1 drop/l (drop/liter)

Pure nickel anodes in leached anode bags, such as those available under the tradename polynap, are placed into the electrolyte. Electrolyte A should be continuously agitated and maintained at a temperature of 50° C. and a pH of 2.30 to 2.60.

If necessary, sodium bicarbonate ($NaHCO_3$) may be used to raise the solution pH and hydrofluoric acid (HF) may be used to lower the pH.

Electrolyte B. Over-Plate Electrolyte

Nickel Sulfamate ($Ni(H_2NSO_3)_2$)—450 ml/l; (24 oz/gal of nickel as metal concentrate)

Boric Acid ($H_3BO_3$)—35 g/l

Sodium Lauryl Sulfate ($C_7H_4NNaO_3S \cdot 2H_2O$)—0.25 g/l

Pure nickel anodes in leached anode bags such as those available under the tradename polynap, are placed into the electrolyte. Electrolyte B should be continuously agitated and maintained at a temperature of 45° C. to 50° C. and a pH of 4.0. The current density shall be 50 amps per square foot. If necessary, sodium bicarbonate ($NaHCO_3$) may be used to raise the solution pH and sulfamic acid ($NH_2SO_3H$) acid may be used to lower the pH.

Adhesion Tests

Adhesion tests were carried out by preheating an oven to 800° C. Samples, initially at room temperature, were plunged into the oven, in an air atmosphere, for five minutes. Each sample was removed after five minutes, placed on a thermal insulator and allowed to cool to room temperature. Each sample was then viewed under an optical microscope for blistering of the nickel electrodeposit, which blistering indicating poor adhesion. The samples made by the process of the present invention did not exhibit blistering.

Surface Morphology

Sample metal substrates, were tested as to density which ranged from 76%–100%. As one would expect, with an increase in density, there is a decrease in porosity. Viewing these samples under magnification, the 76% dense sample has a surface texture resembling a medium grit abrasive paper. The 100% dense samples appear to be a mostly continuous, smooth surface. The less dense samples, when plated, will most likely have a much greater mechanical adhesion than that of the higher density samples. This mechanical bond may be sufficient for some applications, but when subjected to the adhesion testing noted above, seems to play an insignificant role in bonding.

While the invention has been described having reference to a particular preferred embodiment, those having skill in the art will appreciate that various changes may be made without departing from the spirit and scope of the invention as claimed.

What I claim is:

1. A process for electroplating nickel or a nickel alloy onto a metal substrate containing at least a partially oxidized surface, comprising:

immersing the metal substrate to be plated into a reduction/deposition electrolyte comprising nickel and applying a direct current thereto at a reduction potential for a period of time sufficient to electrochemically reduce the oxide on the metal substrate, wherein said reduction potential allows the oxide to be reduced without causing the nickel to be plated out; and after reducing the oxide, changing the reduction potential to a more negative deposition potential and applying a direct current at said deposition potential for a period of time sufficient to electrochemically deposit nickel on the metal substrate.

2. The process of claim 1, wherein the reduction/deposition electrolyte comprises a fluoride.

3. The process of claim 2, wherein the fluoride is selected from the group consisting of hydrofluoric acid and fluoroboric acid.

4. The process of claim 1, wherein the metal substrate is copper-tungsten.

5. The process of claim 1, wherein the metal substrate is selected from the group consisting of tungsten, copper-tungsten and molybdenum and the reduction/deposition electrolyte is comprised of:

30 grams per liter of nickel sulfate;

50 milliliters per liter of hydrofluoric acid;

1 drop per liter of surfactant; and wherein said reduction/deposition electrolyte is maintained at a temperature of about 50° C. and a pH of about 2.30 to about 2.60.

6. The process of claim 5, wherein the reduction potential is about −0.4 V which is maintained for a period of about 2.0 minutes and the deposition potential is about −1.1 V which is maintained for a period of about 2.5 minutes.

7. The process of claim 1, further comprising the additional steps of:

immersing the coated metal substrate into an over-plate electrolyte; and applying a plating potential for a period of time sufficient to electrochemically completely cover the coated metal substrate.

8. The process of claim 7, wherein the over-plate electrolyte is comprised of:

450 milliliters per liter of nickel sulfamate;

35 grams per liter of boric acid;

0.25 grams per liter of sodium lauryl sulfate; and maintaining said over-plate electrolyte at a temperature of about 45° C. to about 50° C and a pH of about 4.0.

9. A process for plating non-noble metal substrates, comprising:

degreasing the metal substrate to be plated in acetone;

rinsing said metal substrate with water;

dipping said metal substrate in 10 v/o sulfuric acid for about 60 seconds;

rinsing said metal substrate with water;

immersing said metal substrate in a reduction/deposition electrolyte with the current on at a reduction potential of about −0.4 V for a period of about 2.0 minutes;

changing the potential to the deposition potential of −1.1 V for about 2.5 minutes;

removing a plated metal substrate from said reduction/deposition electrolyte and immersing said plated metal article into an over-plate electrolyte with the current off;

applying a plating potential for a period of about 5 minutes; and removing an over-plated metal substrate from said over-plate electrolyte, rinsing and drying said over-plated substrate.

10. The process of claim 9, wherein the reduction/deposition electrolyte is comprised of:

30 grams per liter of nickel sulfate;

50 milliliters per liter of hydrofluoric acid;

1 drop per liter of surfactant; and wherein said reduction/deposition electrolyte is maintained at a temperature of 50° C. and a pH of 2.30 to 2.60.

11. The process of claim 10, wherein the metal substrate is copper-tungsten.

12. The process of claim 9, wherein the over-plate electrolyte is comprised of:

450 milliliters per liter of nickel sulfamate;

35 grams per liter of boric acid;

0.25 grams per liter of sodium lauryl sulfate; and wherein said over-plate electrolyte is maintained at a temperature of 45° C. to 50° C. and a pH of 4.0.

13. The process of claim 9, wherein the metal substrate is selected from the group consisting of tungsten, copper-tungsten and molybdenum.

14. The process of claim 9, wherein the plated metal comprises nickel.

15. The process of claim 9, wherein the over-plated metal comprises nickel.

* * * * *